US005820908A

United States Patent [19]

Li

[11] Patent Number: 5,820,908

[45] Date of Patent: Oct. 13, 1998

[54] PRODUCE PACKING AND HANDLING APPARATUS AND METHOD

[75] Inventor: Lien-Chung Li, Taichung, Taiwan

[73] Assignee: Liland Technology, L.L.C., East Syracuse, N.Y.

[21] Appl. No.: 754,751

[22] Filed: Nov. 21, 1996

[51] Int. Cl.[6] ..... A23L 3/00; A23B 7/148; B65B 47/02; B65B 55/14

[52] U.S. Cl. ..... 426/396; 99/450; 99/467; 217/40; 217/124; 426/106; 426/232; 426/392; 53/442; 53/452

[58] Field of Search ..... 99/467, 470, 473–476, 99/450, 449, 485, 483; 426/118, 106, 124, 127, 415, 232, 419, 392, 396; 211/181; 206/484.1, 521, 205, 521.1, 525, 526; 220/485; 217/40, 124, 7, 42; 53/442, 452

[56] References Cited

U.S. PATENT DOCUMENTS

| | | | |
|---|---|---|---|
| 525,112 | 8/1894 | Morey . | |
| 1,836,750 | 12/1931 | Daly . | |
| 1,854,097 | 4/1932 | Bewley . | |
| 2,069,747 | 2/1937 | Atkins | 217/40 |
| 2,124,217 | 7/1938 | Vanbenschoten | 217/42 |
| 3,067,039 | 12/1962 | Crane | 99/171 |
| 3,184,047 | 5/1965 | Gilman et al. | 206/45.34 |
| 3,703,383 | 11/1972 | Kuchenbecker | 99/171 |
| 3,900,129 | 8/1975 | Scholz | 220/306 |
| 4,417,509 | 11/1983 | Deibel et al. | 99/467 |
| 4,515,266 | 5/1985 | Myers | 206/205 |
| 4,525,367 | 6/1985 | Allison | 426/394 |
| 4,627,336 | 12/1986 | Nam | 99/467 |
| 4,656,042 | 4/1987 | Risler | 426/396 |
| 4,949,847 | 8/1990 | Nagata | 206/484.1 |
| 5,497,698 | 3/1996 | Bolkestein | 99/476 |
| 5,501,142 | 3/1996 | Bailey | 99/482 |
| 5,520,941 | 5/1996 | Oosterling | 426/232 |
| 5,566,608 | 10/1996 | Vejdani et al. | 99/467 X |
| 5,570,628 | 11/1996 | Kiener et al. | 99/472 |

*Primary Examiner*—Timothy F. Simone
*Attorney, Agent, or Firm*—Trapani & Molldrem

[57] ABSTRACT

The present invention is concerned with apparatus and methods for packing and handling articles of produce and the like. The apparatus includes a uniquely designed produce basket and rack combination. The basket comprises a framework containing a basket opening. A flange is detachably attached to the framework and surrounds the basket opening. A pair of lugs extend out from the flange, and function as handles for carrying the basket or for pulling the flange to detach it from the basket framework. An air-permeable barrier is heat sealed to the flange to create a closure to the basket opening. The closure is first opened by detaching at least a portion of the basket flange from the framework and is closed by pulling the detached flange portion down around the opening of the framework and engaging a spur. The rack comprises a rack framework which includes a top end containing a plurality of rack openings. Each rack opening is configured and dimensioned to receive a produce basket and suspend the basket by its flange at the top end. The rack tapers from a bottom end to the top end, such that the rack can be stacked with a second rack of similar configuration. The rack can be stacked in either a raised or a lowered stacked configuration.

12 Claims, 10 Drawing Sheets

10
14
16
17
18
22a
24

48
46
40a
40b
30'
32
30

PRODUCE PACKING AND HANDLING APPARATUS AND METHOD

BACKGROUND OF THE INVENTION

1. Technical Field

The present invention relates generally to produce packing and handling, and more particularly to apparatus and methods used in produce packing and handling, including produce baskets and racks.

2. Background Art

It is well known that human contact of produce, especially fruit, promotes spoilage, and that one of the contributing factors to spoilage of fruit during the picking, packing, handling, shipping and displaying process ("field to point-of-sale process"), is human contact. In the conventional process, fruit is normally picked and packed in cartons by hand. After the cartons are shipped to retail shops or supermarkets, they are unpacked from the cartons and re-packed in fruit baskets by hand. The fruit baskets are then placed by hand into show racks for sale. The baskets usually have a lattice framework which permits air-flow through the basket, but also permits human contact with the fruit when the basket is being handled. Various attempts have been made to reduce the amount of human contact during the "field to point-of-sale" process, as evidenced by U.S. Pat. Nos. 3,900,129 to Scholz; 3,703,383 to Kuchenbecker; 3,184,047 to Gilman et. al; 3,067,039 to Crane; 2,124,217 to Van Benschoten; 2,069,747 to Atkins; 1,854,097 to Bewley; 1,836,750 to Daly; and 525,112 to Morey. However, none of these patents propose a comprehensive and efficient solution to the problem of reducing human contact throughout the entire "field to point-of-sale" process.

The conventional cartons used for packing and shipping produce inhibit air circulation through the packed produce, especially when the cartons are stacked. U.S. Pat. No. 2,069,747 to Atkins describes a ventilated packing crate which is stackable; however, such crates require a number of wooden cleats and slats, and metal pins, which require special attention during construction and use. In addition, the crate construction shown in Atkins is not suitable for the dual purposes of transporting produce to and displaying produce at the point-of-sale. Furthermore, the wooden crates in Atkins are heavy and cumbersome.

In an effort to reduce weight and improve handling, paper and cardboard has become a preferred material for constructing produce shipping crates and containers. However, crates made from such materials are, in many cases, used only once and then thrown away. This has led to a waste management and disposal problem. Moreover, such crates are more prone to crushing during stacking and shipment than crates made of a more rigid material.

When produce, especially fruit, is packed and shipped in cartons, the produce is squeezed, pushed, pressed, and inevitably bruised or damaged. Alternative methods to such bulk packaging have been proposed. Many of these involve the use of individually packed baskets, as described, for example, in U.S. Pat. Nos. 2,124,217 to Van Benschoten; 2,069,747 to Atkins; 1,854,097 to Bewley; 1,836,750 to Daly; and 525,112 to Morey. However, such methods present the challenge of how to efficiently and conveniently wrap or cover the baskets, which the above-mentioned patents fail to address. The labor-intensive task of wrapping each individual basket has dissuaded many from performing this step, especially in the field where it is advantageous to wrap or cover the baskets.

When packed baskets are individually wrapped or covered, the conventional approaches involve covering the basket with plastic film or a blister pack cover. The plastic film is usually held to the basket by an elastic band, and the blister pack may be fastened to the basket by staples. Such attachment means are not suitable when re-use of the wrap or cover is required. For instance, if not all of the basket's contents are to be used at one time, there is a need to recover the basket to maintain freshness of the remaining contents. If elastic bands are used, there is a tendency for the bands to break or loosen. If the bands are not sewn or seal into the film, there may be a tendency to misplace the bands after opening the basket. In addition, re-application of an elastic band around a plastic sheet on a basket, requires a high level of dexterity, not normally exhibited by a typical consumer. If staples are used with a blister cover, the re-fastening of the cover is out of the question unless a stapler is readily available.

OBJECTS AND SUMMARY OF THE INVENTION

It is therefore an object of the present invention to provide apparatus and methods that avoid the aforementioned problems associated with the prior art.

It is another object of the present invention to provide apparatus and methods which minimize the frequency and degree of human contact with produce, from field to point-of-sale, and thus reduce spoilage and prolong shelf-life.

It is a further object of the present invention to provide comprehensive and efficient methods of delivering produce from the field to the point-of-sale.

It is yet another object of the present invention to provide produce baskets and racks which permit ample circulation of air through the packed produce, even when such baskets and racks are stacked.

It is yet a further object of the present invention to provide produce packing racks which are re-useable, such that requirements of waste management and disposal are reduced.

It is still another object of the present invention to provide produce packing racks which are of a simple and unitary construction, requiring little attention during use.

It is still a further object of the present invention to provide produce packing racks which are uniquely suited for the dual purposes of transporting produce to and displaying produce at the point-of-sale.

It is yet still another object of the present invention to provide produce packing racks which are lightweight and easy to handle.

It is yet still a further object of the present invention to minimize damage to and contamination of produce during shipment from the field to the point-of-sale.

It is yet still another object of the present invention to provide apparatus and methods which improve, many-fold, the efficiency of wrapping or covering produce baskets in the field.

It is yet still another object of the present invention to provide a re-useable closure for a produce basket which is conveniently applied and re-applied to the basket, such that any remaining contents of the basket are maintained fresh.

These and other objects are obtained in accordance with the present invention wherein there is provided a produce basket which comprises an open lattice framework containing a basket opening defined by a rim. An outwardly extending flange is detachably attached to the rim and surrounds the basket opening. The flange extends out from the basket opening a sufficient amount to support and suspend the basket in a rack which is constructed in accordance with the present invention. The flange is configured and dimensioned to permit an air-permeable barrier to be affixed to the top surface of the flange, for the purpose of closing the basket opening. The air-permeable barrier will protect the contents of the basket from dust, but will allow moist air to escape. The barrier is preferably heat-sealed to the flange.

The basket of the present invention preferably includes a pair of lugs integrally molded with and extending out from the flange. The lugs are each configured and dimensioned to be grasped by at least two fingers, and function as handles for carrying the basket without physically touching the contents of the basket. Each lug also functions as a grip for pulling on the flange to effect a detachment of at least a portion of the flange from the rim. The lugs may further function to support and suspend the basket in a rack constructed in accordance with the present invention.

The basket further comprises a spur which protrudes from the rim and is positioned adjacent to one of the lugs. The adjacent lug is used to pull a detached portion of the flange down around the rim to engage the spur. The spur catches and retains the detached portion of the flange. The basket may include another spur which protrudes from the rim and is positioned adjacent to the other lug.

A re-useable closure for the opening of the basket is created by the combination of the barrier affixed to the flange. The closure is first opened by detaching at least a portion of the flange from the rim. Once opened, the closure is secured closed by pulling the detached portion of the flange down around the rim and engaging the spur.

The produce rack of the present invention is configured and dimensioned to hold produce baskets such as described above. The rack comprises a rack framework which includes an exposed top end and a bottom end. The top end contains a plurality of rack openings, each of which is configured and dimensioned to receive a produce basket and suspend the basket by the basket's flange (and/or lugs) at the top end. The baskets are suspended in the rack so that the basket openings are in substantially the same plane as the top end.

The rack framework tapers from the bottom end to the top end, such that the rack can be stacked (or nested) with a second rack of similar configuration. The rack can be stacked in two different ways. One way is in a "raised nested configuration," and the other way is in a "lowered nested configuration." The raised nested configuration allows the racks to be stacked upon each other while each contains a full complement of packed produce baskets, and keeps the racks sufficiently separated to permit ample circulation of air through the packed produce. The lowered nested configuration allows the racks to be stacked together in a compact assembly to be stored away when not in use. The racks are supported in either a raised or a lowered nested configuration by an arrangement of grooves, recessed shoulders and splines molded into the framework of each rack.

A second embodiment of the produce rack comprises a framework which includes a plurality of sub-frameworks. The sub-frameworks are removably coupled together to form the complete rack framework. Each of the sub-frameworks contains at least one rack opening. At least one of the sub-frameworks has a coupler or attachment mechanism for coupling or attaching to at least one other sub-framework.

In a third embodiment of the rack of the present invention, the top end of the rack includes a sloped ridge bordering each rack opening. The ridge at each rack opening is configured and dimensioned to engage the flange of a produce basket and support and suspend the basket in the rack. The ridge acts as a stop for the flange of the basket, and prevents a loaded basket from falling through the rack opening.

A method of packing and handling articles of produce and the like is also contemplated by the present invention. In the preferred embodiment, the method comprises the steps of: (a) packing a plurality of baskets with articles of produce or the like, wherein each of the baskets includes (i) a basket opening, (ii) a flange surrounding the basket opening, and (iii) a pair of lugs extending out from the basket opening; (b) carrying the packed baskets to a rack, wherein the rack includes an exposed top end which contains a plurality of rack openings; (c) placing the packed baskets into the rack openings, respectively; (d) suspending the baskets in the rack such that the basket openings are substantially in the plane of the top end; (e) applying a barrier over the top end of the rack; and (f) sealing the barrier around the flange of each of the baskets to create closures for the basket openings.

The following advantages are realized from the apparatus and methods of the present invention: (1) from the field to the point-of-sale, human contact with the packed produce is virtually eliminated, and thus spoilage is reduced and shelf-life is prolonged; (2) a comprehensive and efficient approach to packing, packaging, handling, delivering and displaying produce is provided, resulting in the savings of time, labor and costs; (3) ample circulation of air through the packed produce is provided when the baskets and racks are stacked for shipment or display; (4) the racks are re-useable; (5) the racks are of a simple and unitary construction, requiring little attention or maintenance; (6) the racks have a dual purpose of transporting produce to and displaying produce at the point-of-sale; (7) the racks are lightweight and easy to handle; (8) bruising and rot resulting from bruising are avoided by the suspension of the baskets in the racks; (9) a number of produce baskets can be sealed or covered simultaneously rather than one-at-a-time; and (10) a re-sealable closure is established for each produce basket to preserve freshness of remaining contents in the basket.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENTS

Figure 1:
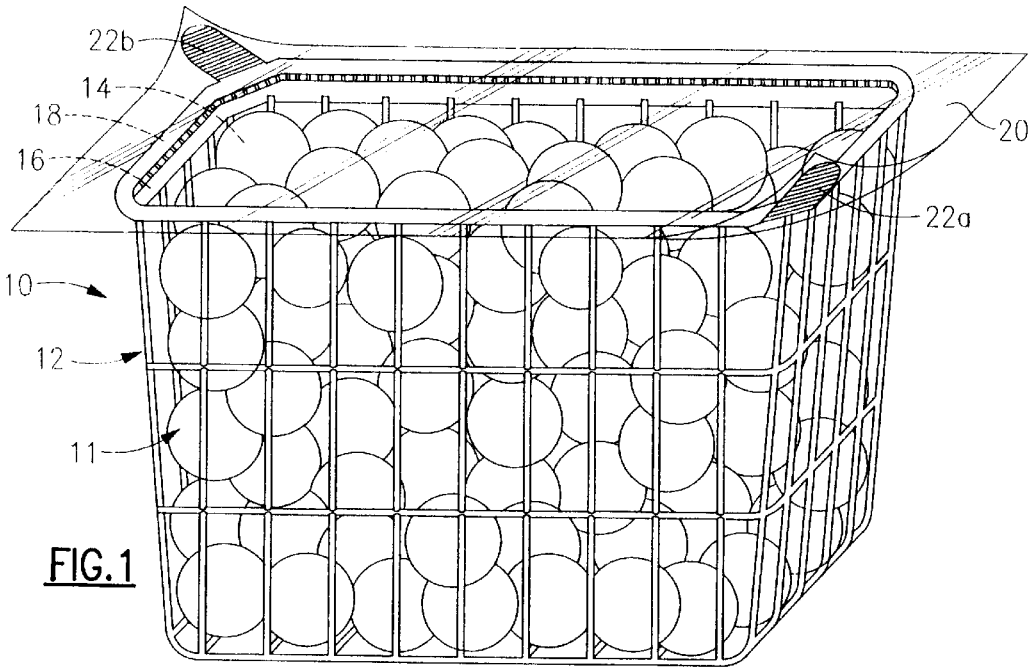
FIG. 1 is a perspective view of a produce basket constructed in accordance with the present invention, showing the basket packed with articles of produce and having a sealed closure which is made of air-permeable film.
Figure 20:
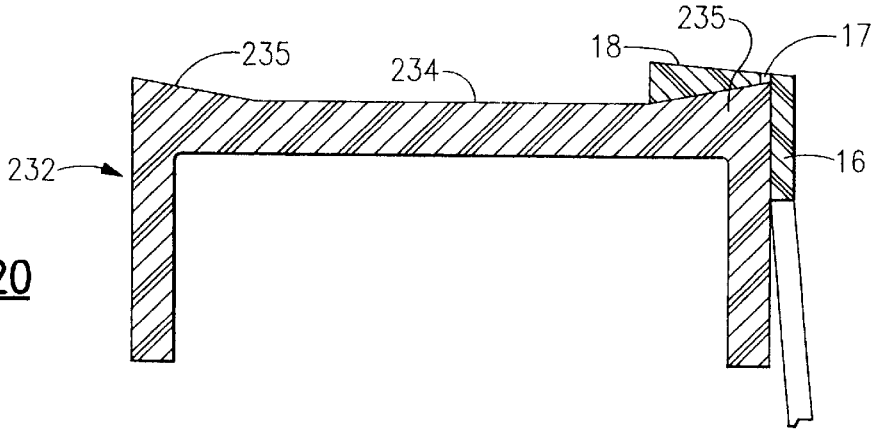
FIG. 20 is a cross-sectional view, taken along line 20—20 in FIG. 19, showing the engagement of a flange of a produce basket with the ridge of the rack.

With reference to FIGS. 1–6, there is shown the preferred construction of the produce basket of the present invention. Referring to FIG. 1, a produce basket 10 is shown packed with articles of produce 11, which may be, for example, strawberries. Basket 10 comprises an open lattice framework 12 containing a basket opening 14 defined by a rim 16. An outwardly extending flange 18 is detachably attached to rim 16 and surrounds opening 14. The attachment of flange 18 to rim 16 is further described in detail hereinbelow with reference to FIG. 2. Flange 18 extends out from opening 14 a sufficient amount to support and suspend basket 10 in a rack constructed in accordance with the present invention (See FIG. 15 and accompanying description below). A cross-sectional view of flange 18 and rim 16 is shown in FIG. 20.

As shown in FIG. 1, flange 18 is configured and dimensioned to permit an air-permeable barrier 20 to be affixed to the top surface of flange 18, for the purpose of closing opening 14. Air-permeable barrier 20 will allow a constant air flow into and out of basket 10, providing both oxygen and proper humidity for its contents. Barrier 20 will protect the contents of basket 10 from dust, but will allow moist air to escape from basket 10. Barrier 20 is preferably a flexible sheet of air-permeable plastic film. In addition, barrier 20 is preferably heat-sealed to flange 18 using a heat sealing machine, as will be further described hereinbelow with reference to FIGS. 16 and 17.

Figure 3:
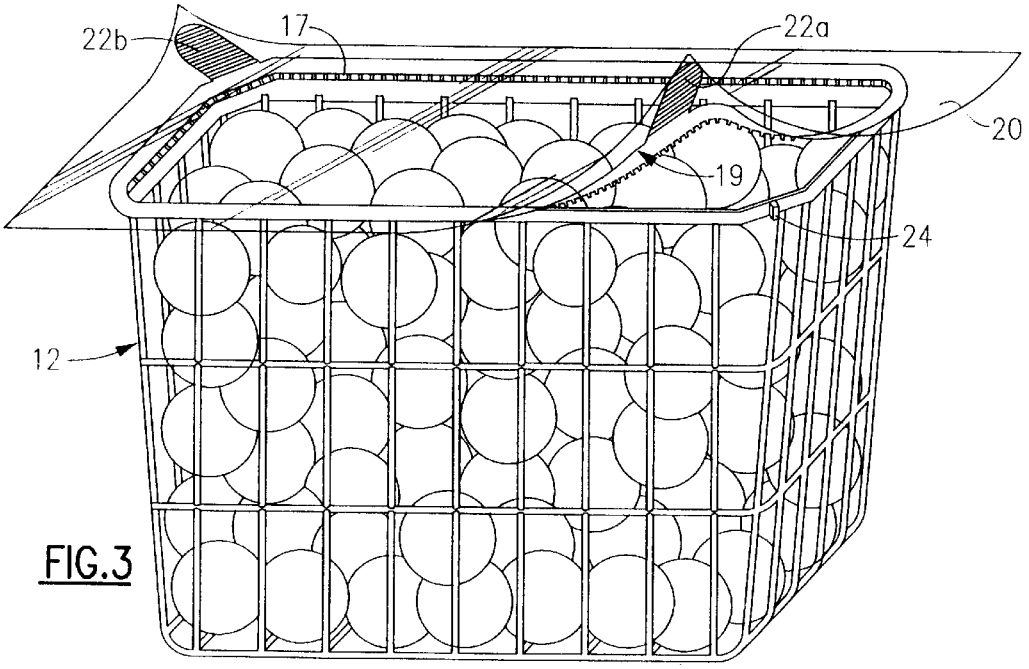
FIG. 3 is another perspective view of the packed produce basket of FIG. 1, with the sealed closure partially opened by a detachment of a portion of the flange from the rim of the basket.

With further reference to FIGS. 1 and 3, basket 10 is shown with a pair of lugs 22*a* and 22*b* integrally molded with and extending out from flange 18. Lugs 22*a* and 22*b* are molded such that they are tilted upward from the horizontal (or from the plane in which flange 18 is oriented) by about 60 degrees. Lug 22*a* is spaced apart from and in substantially opposing relationship with lug 22*b*. Lugs 22*a* and 22*b* are each configured and dimensioned to be grasped by at least two fingers, such as the thumb and forefinger. Lugs 22*a* and 22*b* function as handles for carrying basket 10, and provide a means for handling basket 10 without physically touching the contents of basket 10. The upward tilt of lugs 22*a* and 22*b* allows lugs 22*a* and 22*b* to be easily grasped when basket 10 is suspended in a rack of the present invention.

Lugs 22*a* and 22*b* also each function as a grip for pulling flange 18 to effect a detachment of at least a portion of flange 18 from rim 16 (See FIG. 3). Lugs 22*a* and 22*b* may further function to support and suspend basket 10 in a rack constructed in accordance with the present invention (See FIG. 15 and accompanying description below). The term "lug," as used in this disclosure and the claims, is intended to include any means suitably configured and dimensioned for the purposes as hereinabove described. By way of example, and without limitation, lugs 22*a* and 22*b* may be configured as loops, straps, tabs, knobs, or T-shaped grips.

Figures 4, 5, 6, 8:
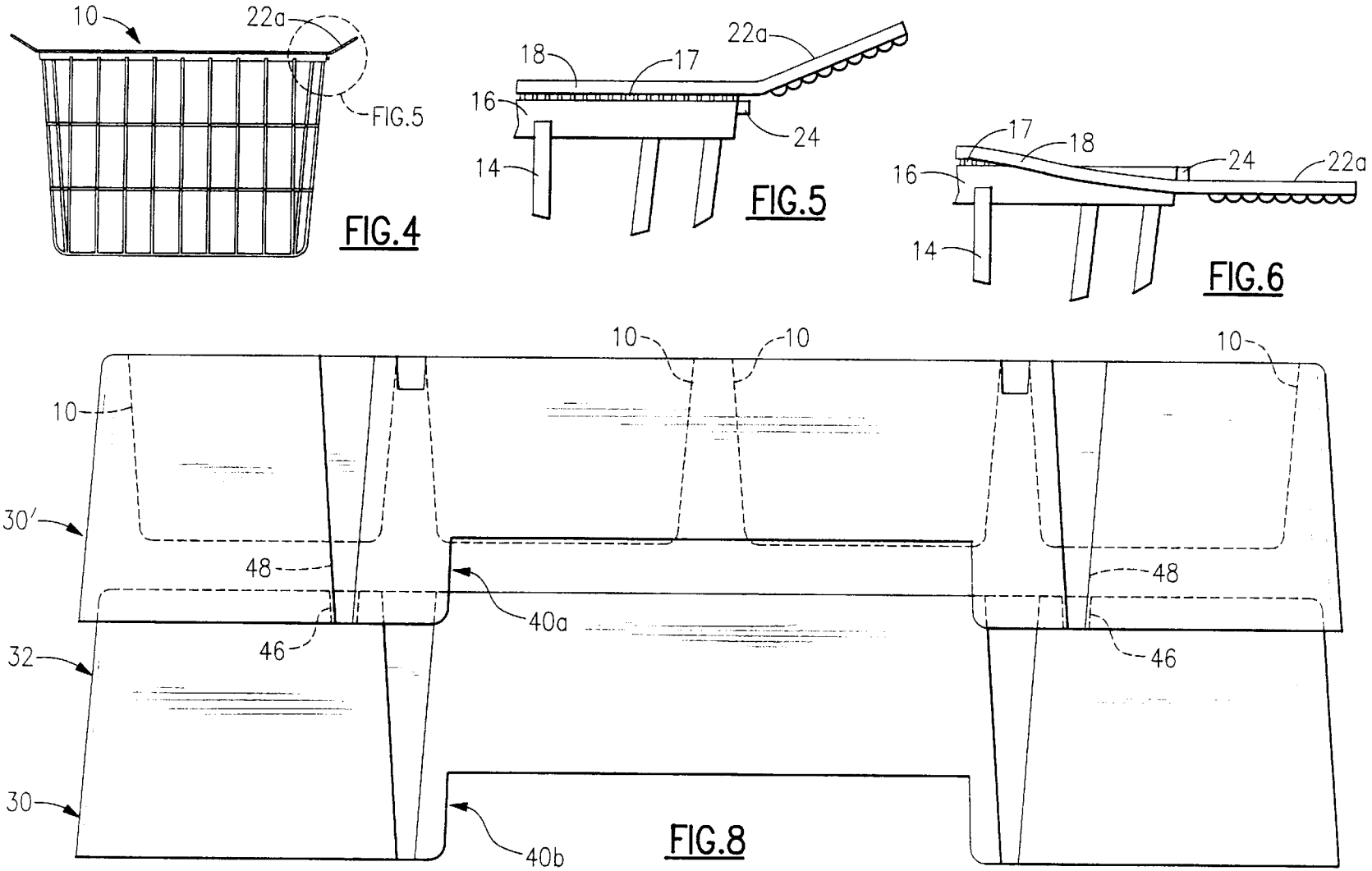
FIG. 4 is side elevation view of the produce basket of FIG. 1 (now empty), focusing attention upon a portion of the flange, rim and framework of the basket, and a corner lug extending from the flange.
FIG. 5 is an enlarged fragmented view of the portion of the basket focused upon in FIG. 4, showing the flange detachably attached to the rim.
FIG. 6 is the same view as FIG. 5, except that it shows a portion of the flange detached from and pulled down around the rim and retained by a spur.
FIG. 8 is a side elevation view of the produce rack of FIG. 7 stacked upon an identical produce rack, in a raised nested position.

As shown in FIGS. 3, 5 and 6, basket 10 further comprises a spur 24, integrally molded with and protruding from rim 16. Spur 24 is positioned, configured and dimensioned to catch and retain a detached portion of flange 18 when such portion is pulled down around rim 16, and engaged by spur 24 (See FIG. 6). As shown in FIG. 5, spur 24 is positioned adjacent to and directly below lug 22*a* when flange 18 is attached to rim 16. This relative positioning allows lug 22*a* to be used to maneuver flange 18 down around rim 16 and easily engage spur 24 (See FIG. 6). Basket 10 may include another spur (not shown) integrally molded with and protruding from rim 16, at a location space apart from and in opposing relationship with spur 24. Preferably, the other spur would be adjacent to and directly below lug 22*b*, and function in the same way as spur 24.

Figure 2:
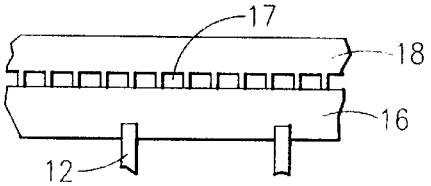
FIG. 2 is an enlarged, fragmented view of the molded pattern of perforations joining the flange to the rim of the produce basket of FIG. 1.

Referring now to FIG. 2, the attachment of flange 18 to rim 16 will now be described. FIG. 2 is an enlarged view of a portion of flange 18 attached to a portion of rim 16. The detachable (or removable) attachment is preferably realized by molding a pattern or train of perforations 17 between flange 18 and rim 16. Alternatively, flange 18 may be spot welded to rim 16. Any suitable means may be employed for achieving a removable attachment of flange 18 to rim 16.

As now understood from FIG. 3, a unique closure 19 is created by the combination of barrier 20 affixed to flange 18. Closure 19 is first opened by detaching at least a portion of flange 18 from rim 16. Once opened, closure 19 is secured closed by pulling the detached portion of flange 18 down around rim 16 and engaging spur 24 (See FIG. 6). Thus, a re-useable closure is provided for produce basket 10, which is conveniently opened to retrieve the contents from basket 10, and conveniently closed to preserve the freshness of any remaining contents in basket 10.

Figure 7:
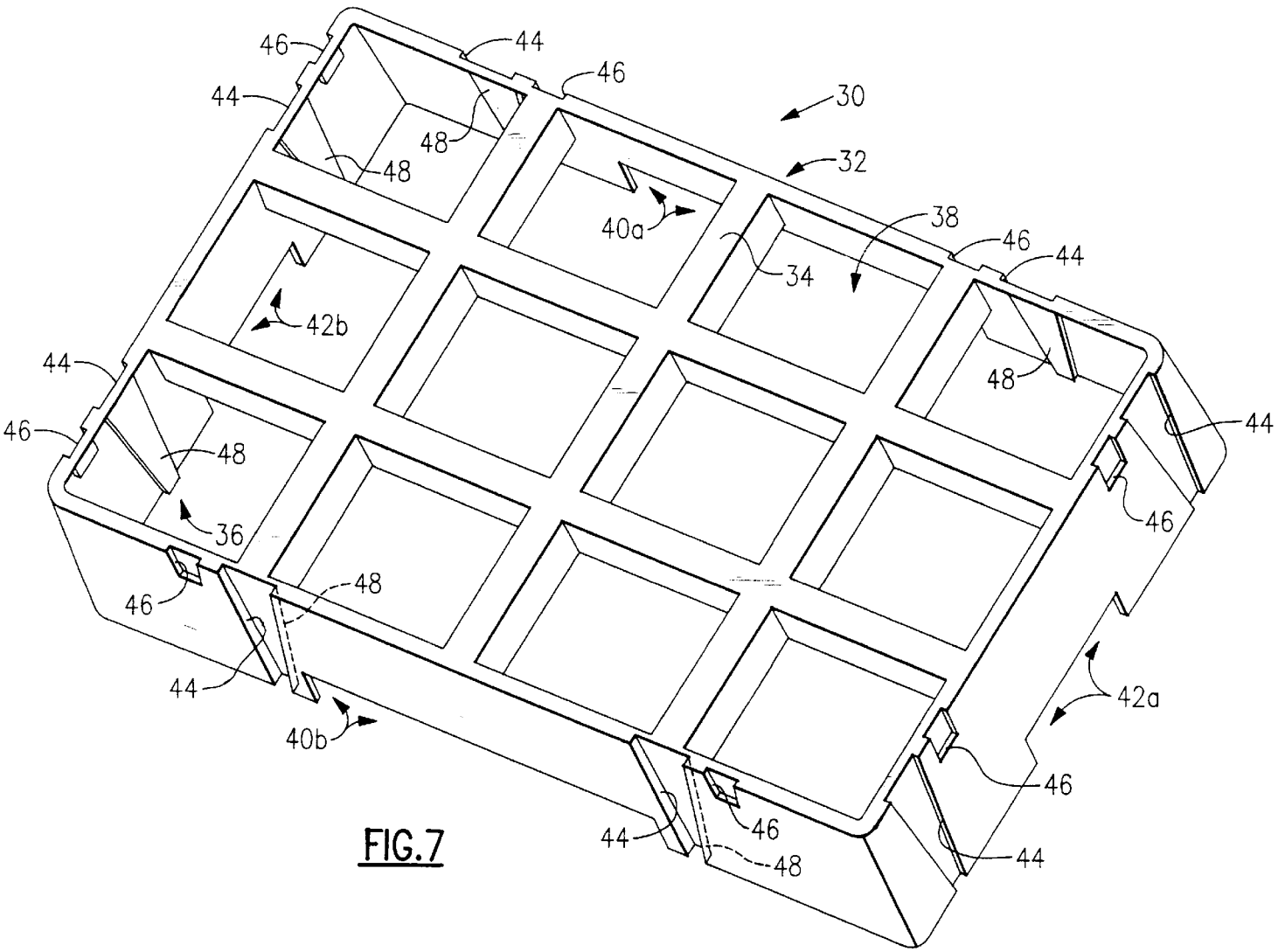
FIG. 7 is a perspective view of one embodiment of a produce rack constructed in accordance with the present invention.

Referring now to FIG. 7, there is shown a first embodiment of a produce rack 30 constructed in accordance with the present invention. Rack 30 is configured and dimensioned to hold produce baskets such as described above with reference to FIGS. 1–6. Rack 30 comprises a rack framework 32 which includes an exposed top end 34 and a bottom end 36. Top end 34 contains twelve rack openings 38, each of which is configured and dimensioned to receive produce basket 10 and suspend basket 10 by flange 18 and/or by other projections (such as lugs 22*a* and 22*b*) at top end 34 (See FIG. 15). In this embodiment, top end 34 is substantially planar. Baskets 10 are intended to be suspended in rack 30 so that basket openings 14 of baskets 10 are in substantially the same plane as top end 34 (See FIG. 18). The height of framework 32 is designed to be greater than the height of baskets 10, to ensure that baskets 10 are suspended in rack 30 when rack 30 is resting on a flat surface or stacked with another rack 30 (See, e.g., FIG. 8).

Rack 30 is preferably made of a lightweight durable plastic material so that it can be re-used several times in the "field to point-of-sale" process. The re-usable nature of rack 30 reduces waste disposal requirements associated with conventional paper and cardboard containers. The lightweight and rigid nature of rack 30 makes it easy to handle during the entire "field to point-of-sale" process. As understood from FIG. 7, rack 30 is of a simple and unitary construction, requiring little attention during use.

Figure 9:
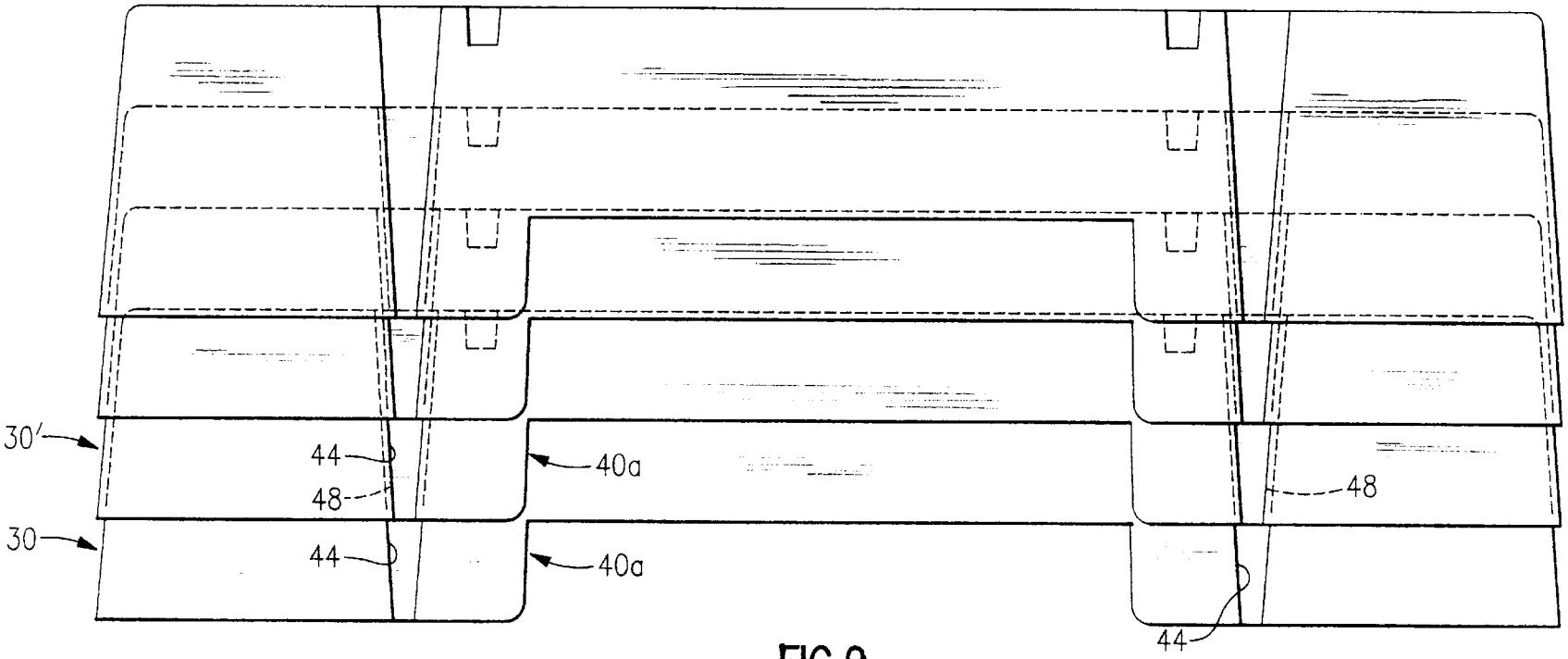
FIG. 9 is a side elevation view of four produce racks of the present invention, stacked together in a lowered nested configuration.

As shown in FIGS. 7–9, bottom end 36 of framework 32 is open, and framework 32 tapers from bottom end 36 to top end 34, such that rack 30 can be stacked (or nested) with a second rack of a similar configuration (See FIGS. 8 and 9). Rack 30 is uniquely designed to be stacked in two different ways. One way is in a "raised nested configuration" as shown in FIGS. 8 and 18, and the other way is in a "lowered nested configuration" as shown in FIG. 9.

Figure 18:
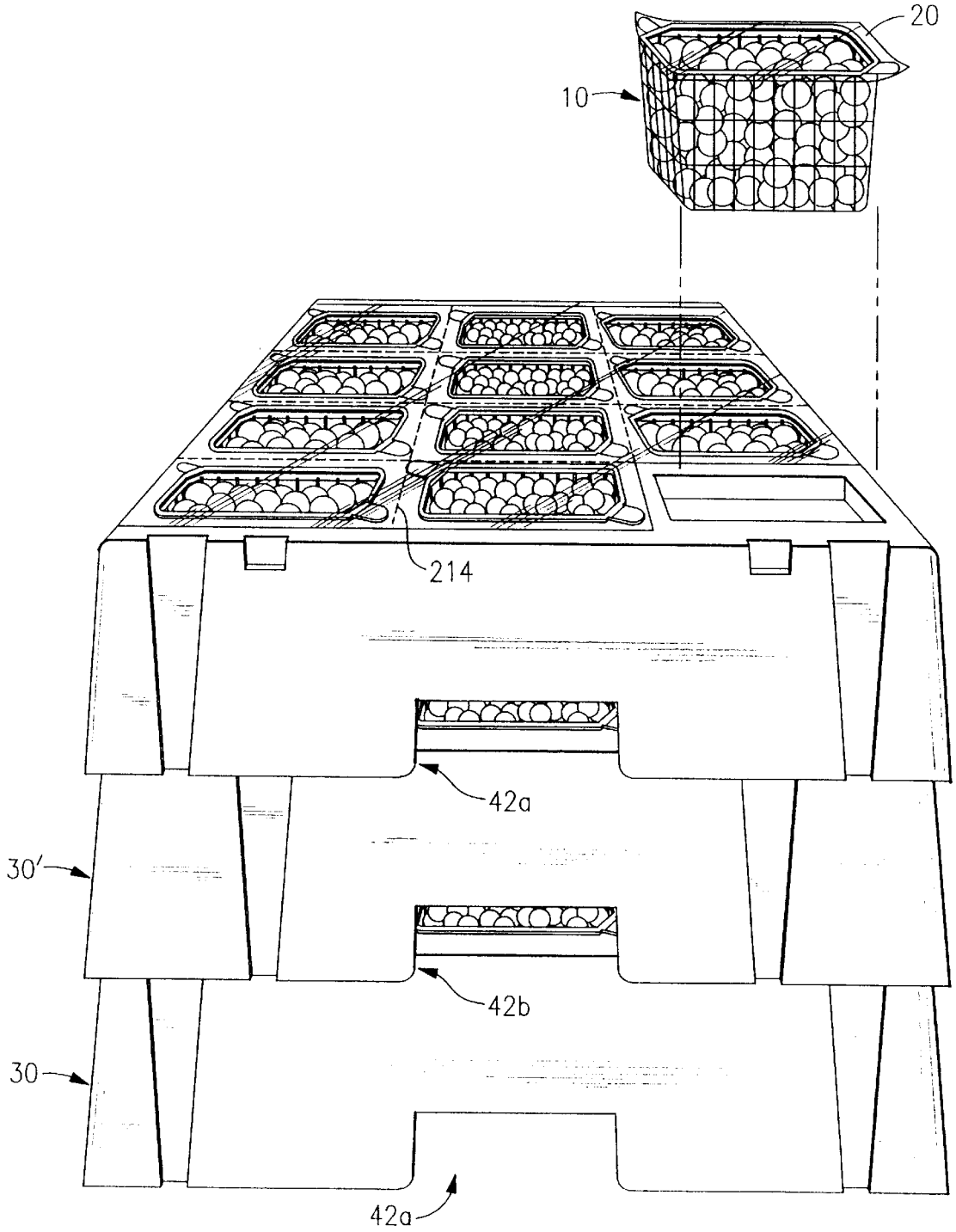

As best shown in FIG. 18, the raised nested configuration allows racks 30 to be stacked upon each other while each contains a full complement of packed produce baskets 10. This configuration is suitable for shipment, storage and display of produce, because each basket 10 is suspended and isolated from the other baskets in the same rack and the other racks above and/or below it. In this way, damage or bruising of produce, especially fruit, is minimized or eliminated.

The raised nested configuration also keeps racks 30 sufficiently separated to permit ample circulation of air through the packed produce. As shown in FIG. 7, framework 32 of rack 30 contains two side recesses 40*a* and 40*b*, and two end recesses 42*a* and 42*b*. These recesses permit air to circulate between the racks when the racks are in a raised nested configuration (See FIGS. 8 and 18). Air circulation or ventilation may be improved further if racks 30 have lattice frameworks, or otherwise contain vent holes or perforations.

As shown in FIG. 9, the lowered nested configuration allows racks 30 to be stacked together in a compact assembly when the racks are empty. Such a compact assembly is suitable for storing the racks when not in use.

The means for supporting racks 30 in either a raised or a lowered nested configuration will now be described with reference to FIGS. 7–9. As shown in FIG. 7, framework 32 contains two tapered grooves 44 on each of the four sides of framework 32, which run between top end 34 and bottom end 36. Grooves 44 are preferably molded in the side walls of framework 32. In addition, framework 32 contains two recessed shoulders 46 on each of the four sides of framework 32. Shoulders 46 are also preferably molded into framework 32. Framework 32 also contains eight tapered splines 48 projecting out from the inner side surfaces of framework 32. Splines 48 correspond to grooves 44, and are configured and dimensioned to mate with and slide into grooves 44 of another rack. The bottom tips of splines 48 are also configured and dimensioned to slide into and rest on shoulders 46 of another rack.

Note from FIG. 7, that the relative positions of grooves 44 and shoulders 46 are reversed on opposite sides of framework 32. This arrangement permits a second rack 30' to be supported in a raised nested position above framework 32 of rack 30, when framework 32 is oriented in an initial position relative to rack 30' (See FIG. 8). Rack 30' is supported in a lowered nested position above framework 32 of rack 30, when framework 32 is rotated 180 degrees from the initial position and the orientation of rack 30' has not changed (See FIG. 9). As understood from FIG. 8, splines 48 of rack 30' engage and are supported by recessed shoulders 46 of rack 30, such that rack 30' is supported above top end 34 of rack 30, in a raised nested position. As understood from FIG. 9, splines 48 of rack 30' slidably engage grooves 44 of rack 30 until rack 30' is stopped by top end 34 of rack 30. Top end 34 of rack 30 functions to support rack 30' above rack 30, in a lowered nested position.

Figure 10:
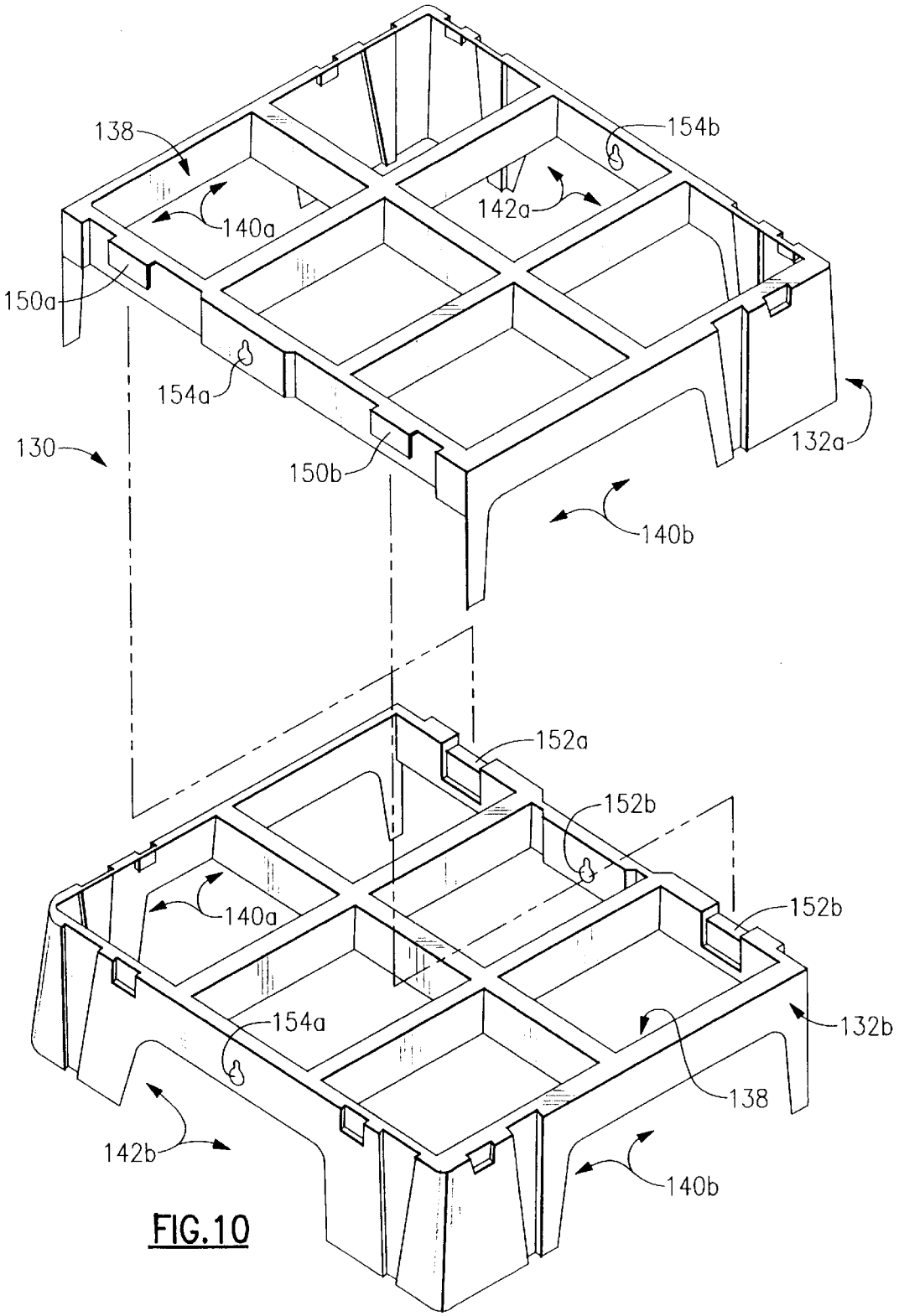
FIG. 10 is a top perspective view of a second embodiment of a produce rack constructed in accordance with the present invention, showing two interlocking sub-rack units.

Referring now to FIG. 10, a second embodiment of the produce rack of the present invention is shown. A rack 130 comprises a framework which, in turn, includes two interlocking sub-frameworks (or sub-rack units) 132*a* and 132*b*. Each sub-framework contains six rack openings 138, and a pair of oppositely disposed side recesses 140*a* and 140*b*. Sub-framework 132*a* contains an end recess 142*a*, and sub-framework 132*b* contains an end recess 142*b*. Rack 130 includes the same arrangement of grooves, recessed shoulders and splines as rack 30, and they operate in the same way to effect both raised and lowered nested configurations of a plurality of racks 130.

As shown in FIG. 10, sub-framework 132*a* includes a pair of male couplings 150*a* and 150*b* which are made to couple to (or mate with) a corresponding pair of recesses 152*a* and 152*b*, respectively, contained in sub-framework 132*b*. As clearly understood from FIG. 10, couplings 150*a* and 150*b* provide a means for removably coupling sub-framework 132*a* to sub-framework 132*b*.

Figure 11:
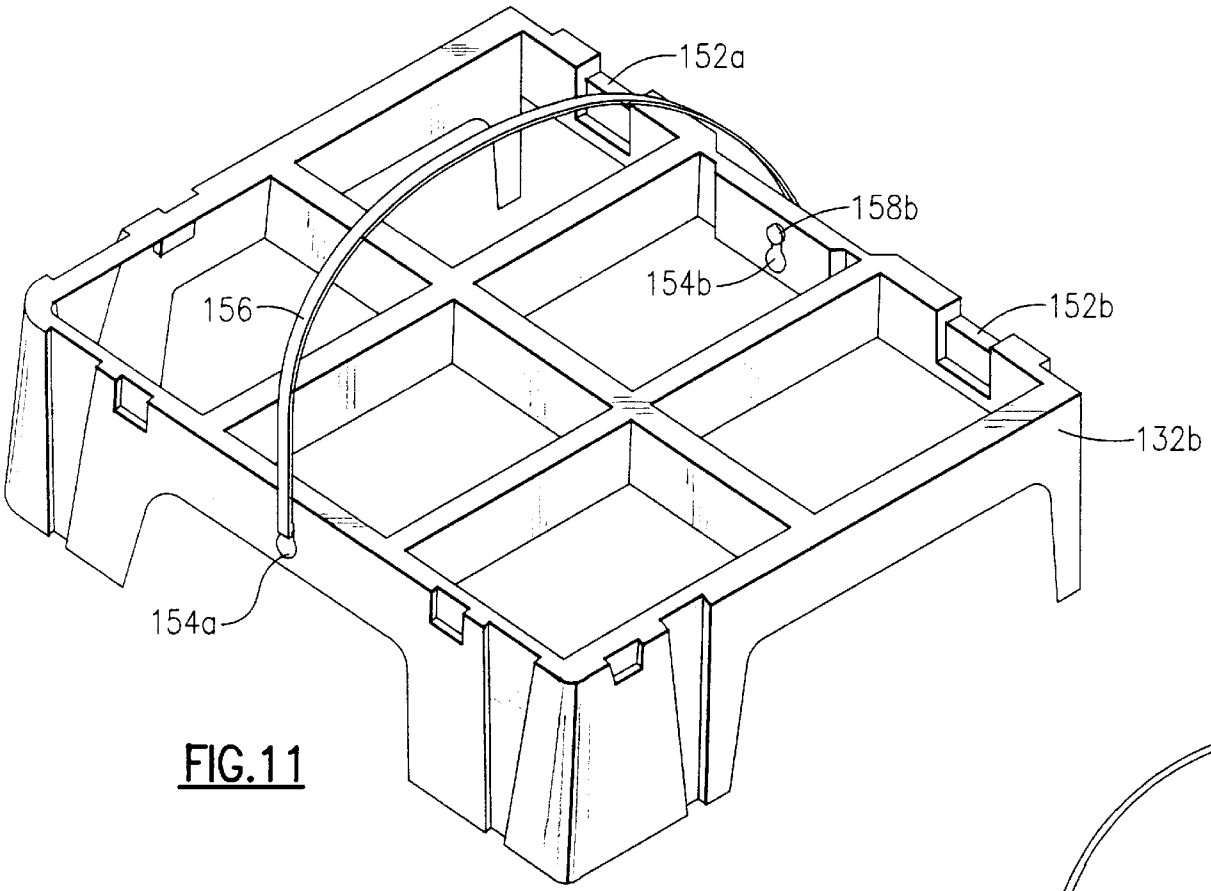
FIG. 11 is a top perspective view of one of the sub-rack units, shown with a strap handle.
Figure 12:
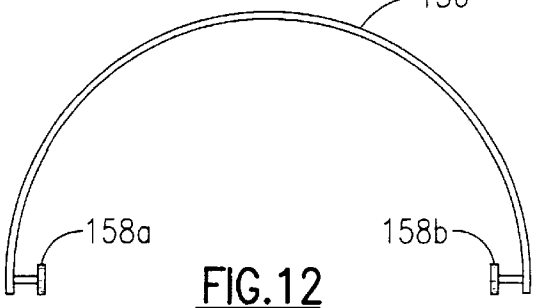
FIG. 12 is a side elevation view of the strap handle used in FIG. 11.

With further reference to FIG. 10, sub-frameworks 132*a* and 132*b* both contain a pair of oppositely disposed slotted holes 154*a* and 154*b*. Slotted holes 154*a* and 154*b*, in each sub-framework, provides means for securing both ends of a strap handle 156 (See FIG. 11). As shown in FIG. 11, the securement of strap handle 156 to sub-framework 132*b* forms a handle for sub-framework 132*b*. As shown in FIG. 12, strap handle 156 includes a pair of coupling ends 158*a* and 158*b*. To secure strap 156 to sub-framework 132*b*, coupling ends 158*a* and 158*b* are inserted through the circular portion of holes 154*a* and 154*b*, and then pulled upward to secure coupling ends 158*a* and 158*b* in the slotted portion of holes 154*a* and 154*b*.

Figure 13:
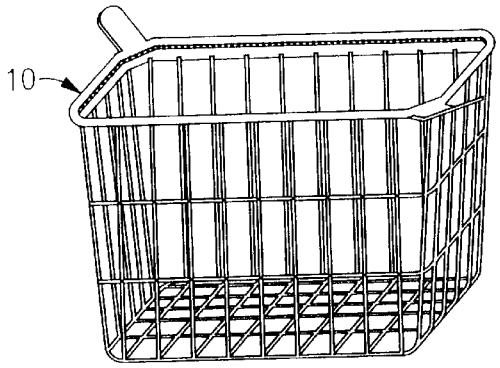
FIGS. 13–18 are a series of views illustrating a method of the present invention for packing and handling produce, from the field to the point-of-sale.
Figure 14:
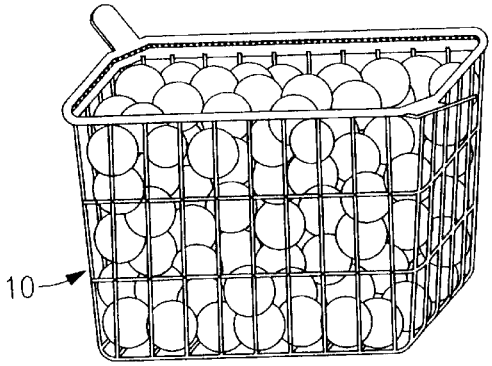
Figure 15:
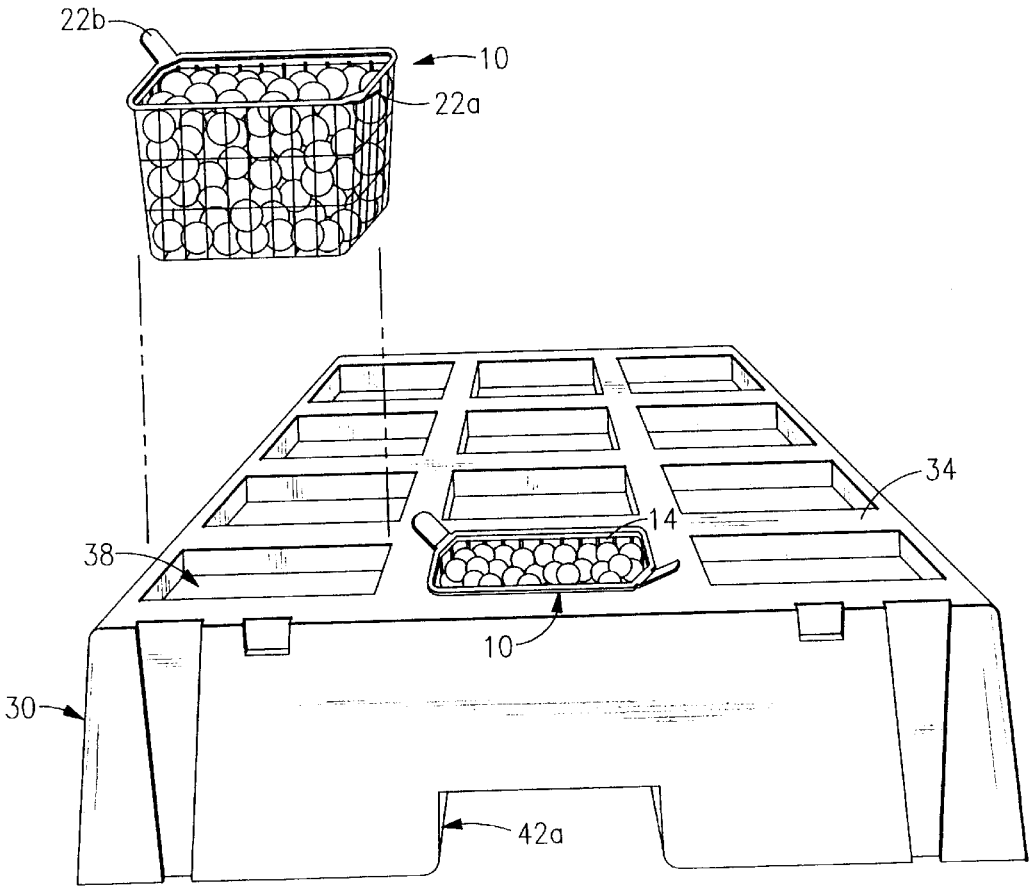

A method of packing and handling produce from the field to the point-of-sale will now be described with reference to FIGS. 13–18. It is contemplated by the present invention that baskets 10 be brought to and packed in the field. FIG. 13 represents an empty basket 10 brought into the field. FIG. 14 shows basket 10 now packed with produce, such as berries, picked in the field. FIG. 15 represents the step of carrying packed basket 10 by lugs 22*a* and 22*b* to a rack 30, and placing basket 10 into rack opening 38 from top end 34. FIG. 15 also illustrates the step of suspending basket 10 in rack 30 such that basket opening 14 is substantially in the plane of top end 34. Each basket 10 is suspended in rack 30 by flange 18. In the preferred method of the present invention, the above-mentioned steps are performed in the field.

Figure 16:
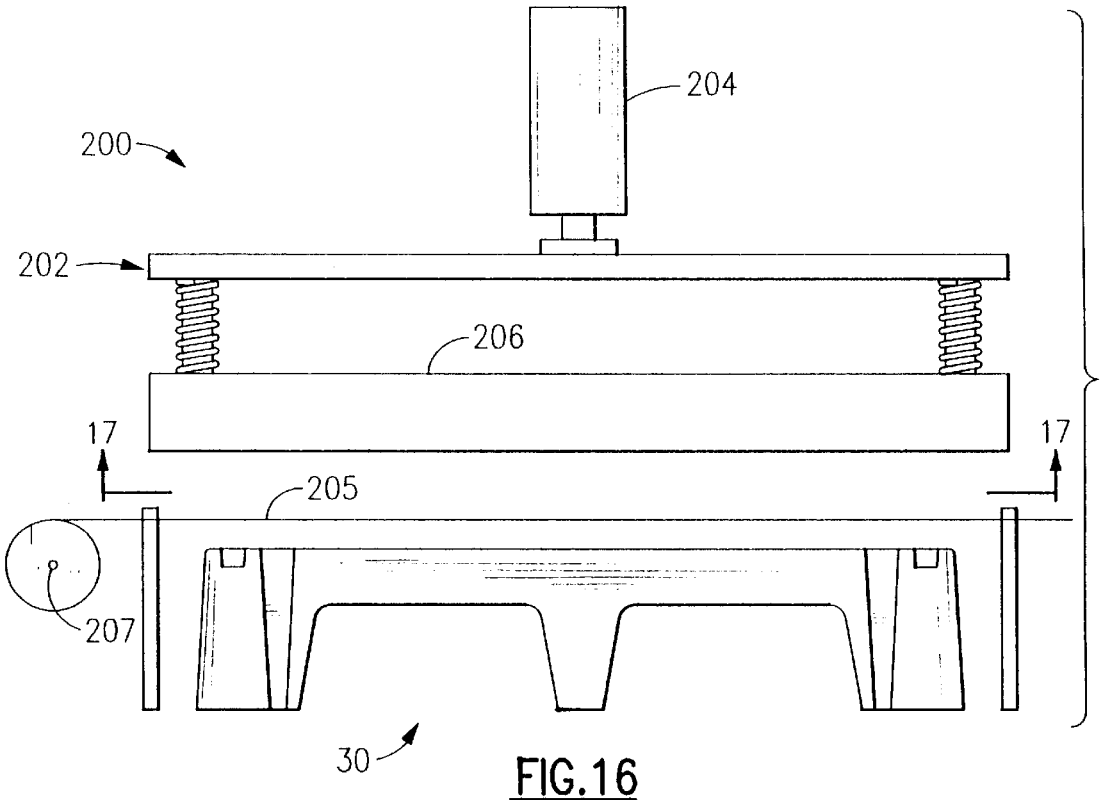
Figure 17:
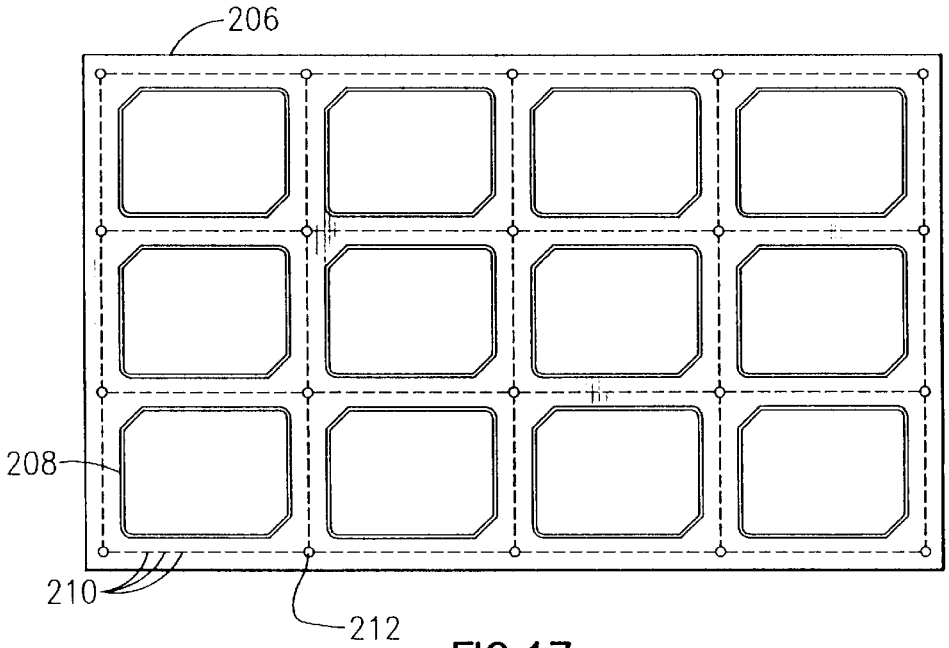

After rack 30 is loaded with twelve packed baskets, it is brought to a heat sealing machine 200, as shown in FIG. 16. Sealing machine 200 is of a conventional design, and thus its construction and operation will not be described in detail. Machine 200 includes a table or track (not shown) on which rack 30 is placed. Rack 30 is positioned under a die press 202 which includes a ram 204 and a heating and cutting element 206. Element 206 is configured to correspond with the pattern of rack openings in rack 30. The configuration of element 206 is shown in FIG. 17. In an alternative arrangement, rack 30 may first be placed into a carriage having wheels (not shown). The carriage and rack are then placed on the table or track and wheeled into positioned under die press 202.

As shown in FIG. 17, element 206 includes twelve heat sealing elements 208, each corresponding in shape and size to flange 18 of basket 10. Surrounding each heating element 208, is a series of cutting blades 210 which define the perimeter of each barrier 20 to be sealed on flange 18 of baskets 10. Sharp pin-like elements 212 may be included at each corner of the cutting blade patterns to promote separation of each barrier 20.

In operation of machine 200, a sheet of air-permeable plastic film material 205 is unrolled from a roller 207, and draped over top end 34 of a fully packed rack 30, as illustrated in FIG. 16. Ram 204 is then activated to lower die element 206 down to make contact with sheet 205. Die element 206 urges sheet 205 against the flanges 18 of baskets 10 to heat seal sheet 205 to each flange 18. Blades 210 and pins 212 pierce sheet 205 around each flange 18 to produce a perforated pattern 214 (See FIG. 18) which defines each barrier 20. Perforated patterns 214 on sheet 205 will allow each barrier 20 to tear away neatly from sheet 205 when individual baskets are removed from the rack. Once the piercing step is completed, ram 204 is raised and rack 30 is removed. It is therefore seen that twelve packed produce baskets can be sealed or covered in one stroke, thus achieving a twelve-fold increase in packaging efficiency over the single-basket packaging method.

The heat sealing and cutting step can be realized in a number of different ways known in the relevant art. For example, the cutting process may be accomplished with a single blade, by passing rack 30 under the blade six times, each time along a different line in a grid defined by the twelve baskets in rack 30 (See FIG. 17). It may also be desirable to completely cut each barrier 20 out of sheet 205, rather than leave barriers 20 connected together by perforations 214.

The description of the produce packing and handling method of the present invention continues with reference to FIG. 18. Once rack 30 is removed from heat sealing machine 200, it is loaded for shipment to a point-of-sale location, such as a retail store or supermarket. As other racks are sealed closed in machine 200, they are then stacked together in a raised nested configuration for shipment (See FIG. 18). Once the sealed racks are delivered to the point-of-sale location, they are put on display for sale to consumers.

The racks may be displayed either in a stacked configuration or individually. If a consumer wishes to purchase a basket of produce, all he or she needs to do is remove a basket from the top-most rack, as illustrated in FIG. 18. The act of removing the basket from the rack will cause perforations 214 to tear neatly, leaving barrier 20 intact and sealed on flange 18 of the removed basket (See FIG. 18). As described with reference to FIG. 3, the combination of barrier 20 and flange 18 functions as a re-sealable closure for basket 10, which the consumer can use for keeping the basket's contents fresh if not consumed all at once.

It is thus understood from the above description that there is no human contact with the packed produce, from the time it is placed into the basket to the time it is purchased by a consumer. As a result, it is expected that the shelf-life of the produce could more than double, if packed and handled in accordance with the present invention.

Figure 19:
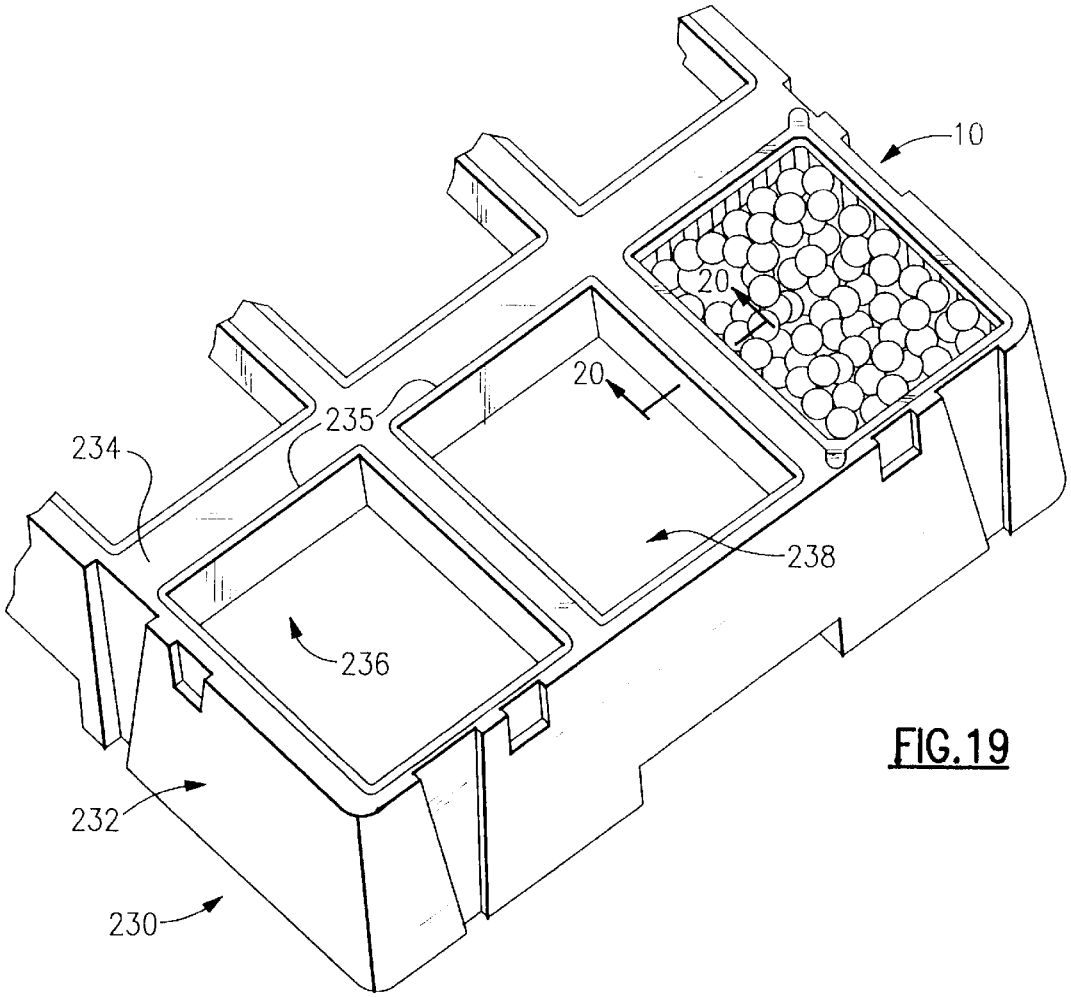
FIG. 19 is a fragmented perspective view of a third embodiment of a produce rack of the present invention, showing a sloped ridge bordering the edge of each rack opening.

Referring now to FIGS. 19 and 20, there is shown a third (and preferred) embodiment of the rack of the present invention. As shown, a rack 230 comprises a rack framework 232 having a top end 234 and a bottom end 236. Rack 230 contains twelve rack openings 238 (only three of which are completely shown). The distinctive feature of this embodiment is that top end 234 includes a sloped ridge 235, bordering each rack opening 238. Ridge 235, at each opening 238, is configured and dimensioned to engage flange 18 of produce basket 10 and hold flange 18 against the weight of basket 10 (See FIG. 20). Basket 10 is supported and suspended in rack 230 on ridge 235 of top end 234. Ridge 235 functions as a stop for flange 18, and aids in preventing a loaded basket 10 from falling through opening 238.

As shown in FIG. 20, flange 18 engages ridge 235 in a close mating relationship. Flange 18 has a wedge-shaped cross-section which is complementary in dimension and shape to the cross-section of ridge 235. As understood from FIG. 20, ridge 235 provides an uphill slope for flange 18, making it more difficult for flange 18 to slide off the edge of top end 234 when basket 10 is weighted down with a full load of produce. It is said that ridge 235 holds flange 18 against the weight of basket 10.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What I claim is:

1. A system for handling articles comprising:

a basket into which articles are packed, said basket including a basket opening and a flange surrounding the basket opening; and a rack having an opened top end and a bottom end, the top end containing a rack opening into which said basket is received and at which said basket is suspended by its flange being carried by the top end of said rack.

2. The system as recited in claim 1, comprising a plurality of baskets, and wherein the top end of said rack includes a plurality of rack openings into which said plurality of baskets are received and suspended, respectively.

3. The system as recited in claim 2, further comprising an air-permeable barrier covering the top end of said rack as said plurality of baskets are suspended in said rack, such that the openings of said plurality of baskets are closed by said barrier.

4. The system as recited in claim 3, wherein said air-permeable barrier is sealed around the flange of each of said plurality of baskets such that a closure is established for each of said baskets.

5. The system as recited in claim 4, wherein the flange of each of said plurality of baskets is detachably attached to the basket, and wherein the closure of each of said baskets is first opened by detaching at least a portion of the flange from the basket and is secured closed by pulling the detached flange portion down around the basket opening.

6. The system as recited in claim 5, wherein each of said plurality of baskets includes a spur projecting out from the basket and being positioned, configured and dimensioned to catch and retain a detached portion of the flange when said portion is pulled down around the opening of said basket and engaged by said spur.

7. The system as recited in claim 6, wherein each of said plurality of baskets includes a plurality of lugs extending out from and being spaced apart around the flange of said each basket, said lugs being configured and dimensioned to be grasped and pulled to effect a detachment, at least in part, of the flange from said basket.

8. A system for handling articles, comprising:

a basket into which articles are packed, said basket including a basket opening and a plurality of lugs extending out from the opening, said lugs being spaced apart around the opening of said basket; and a rack having an opened top end and a bottom end, the top end containing a rack opening into which said basket is received and at which said basket is suspended by the plurality of lugs being carried by the top end of said rack.

9. A method of packing articles, comprising the steps of:

(a) placing articles in a basket, said basket including (i) a basket opening, (ii) a flange surrounding the basket opening, and (iii) a pair of lugs extending out from the basket opening;

(b) carrying the basket by the pair of lugs to a rack, said rack including an opened top end which contains a rack opening;

(c) placing the basket into the rack opening of said rack;

(d) suspending the basket in the rack such that the basket opening is substantially in the plane of the top end;

(e) applying a barrier over the top end of the rack; and (f) sealing the barrier around the flange of the basket to create a closure for the basket opening.

10. A method of packing articles, comprising the steps of:

(a) packing a plurality of baskets with articles, each of said plurality of baskets including (i) a basket opening, (ii) a flange surrounding the basket opening, and (iii) a pair of lugs extending out from the basket opening;

(b) carrying the plurality of packed baskets to a rack, said rack including an opened top end which contains a plurality of rack openings;

(c) placing the plurality of packed baskets into the plurality of rack openings, respectively;

(d) suspending the plurality of baskets in the rack such that the basket openings are substantially in the plane of the top end;

(e) applying a barrier over the top end of the rack; and (f) sealing the barrier around the flange of each of the plurality of baskets to create closures for the basket openings.

11. The method as recited in claim 10, further comprising the step of stacking the rack, after performing step (f), on top of a second rack which has been previously packed.

12. The method as recited in claim 10, further comprising the step of removing one of said plurality of packed and sealed baskets from said rack.

* * * * *